United States Patent [19]

Morse

[11] Patent Number: 5,019,866

[45] Date of Patent: May 28, 1991

[54] PRESSURIZED SCREEN ASSEMBLY FOR EXPOSURE OF A CONTINUOUS TONE IMAGE

[75] Inventor: John E. Morse, E. Irondequoit, N.Y.

[73] Assignee: Eastman Kodak Company, Rochester, N.Y.

[21] Appl. No.: 419,801

[22] Filed: Oct. 11, 1989

[51] Int. Cl.[5] ..... G03G 15/32

[52] U.S. Cl. ..... 355/239; 430/5

[58] Field of Search ..... 355/239, 312, 71, 73, 355/133; 430/5, 6, 396

[56] References Cited

U.S. PATENT DOCUMENTS

| | | | |
|---|---|---|---|
| 3,834,815 | 9/1974 | Greig | 355/91 |
| 4,080,068 | 3/1978 | Madigan et al. | 355/73 |
| 4,089,603 | 5/1978 | Jacobs | 355/73 |
| 4,176,947 | 12/1979 | Spence-Bate et al. | 355/53 |
| 4,240,725 | 12/1980 | Spence-Bate et al. | 354/3 |
| 4,360,266 | 11/1982 | Takeuchi | 355/91 |
| 4,537,490 | 8/1985 | Stoudt | 355/239 X |
| 4,697,194 | 9/1987 | Spence-Bate | 346/110 V |
| 4,737,824 | 4/1988 | Sakai et al. | 355/73 X |
| 4,812,883 | 3/1989 | Ohlig | 355/91 |
| 4,901,104 | 2/1990 | Sakakibara | 355/71 X |

*Primary Examiner*—A. T. Grimley
*Assistant Examiner*—Robert Beatty
*Attorney, Agent, or Firm*—Warren W. Kurz

[57] ABSTRACT

In a reprographic or graphic arts application halftoned latent images of a continuous tone original image are created by imagewise exposure of a photosensitive member through a pressurized screen assembly. A transparent platen supports the original with one or more lamps being provided to illuminate the original resting on the platen. The light image produced is transmitted by an optical system through the pressurized screen assembly to the image plane of a photosensitive member to create the latent image. A pressurized cell within the screen assembly prevents sagging of the screen such that in the image plane of the projected image, the spacing of the halftone imaged pattern is uniform. A single blower system is provided to supply either a negative or positive pressure for the cell, depending upon the direction of sag.

10 Claims, 4 Drawing Sheets

FIG. 4
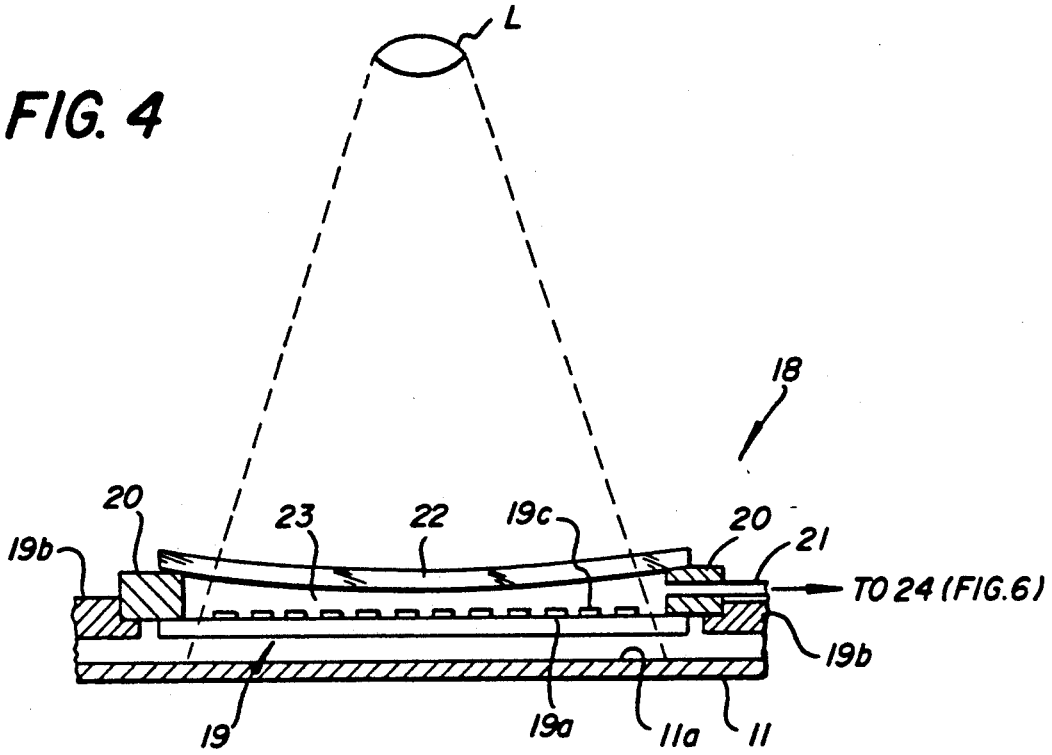
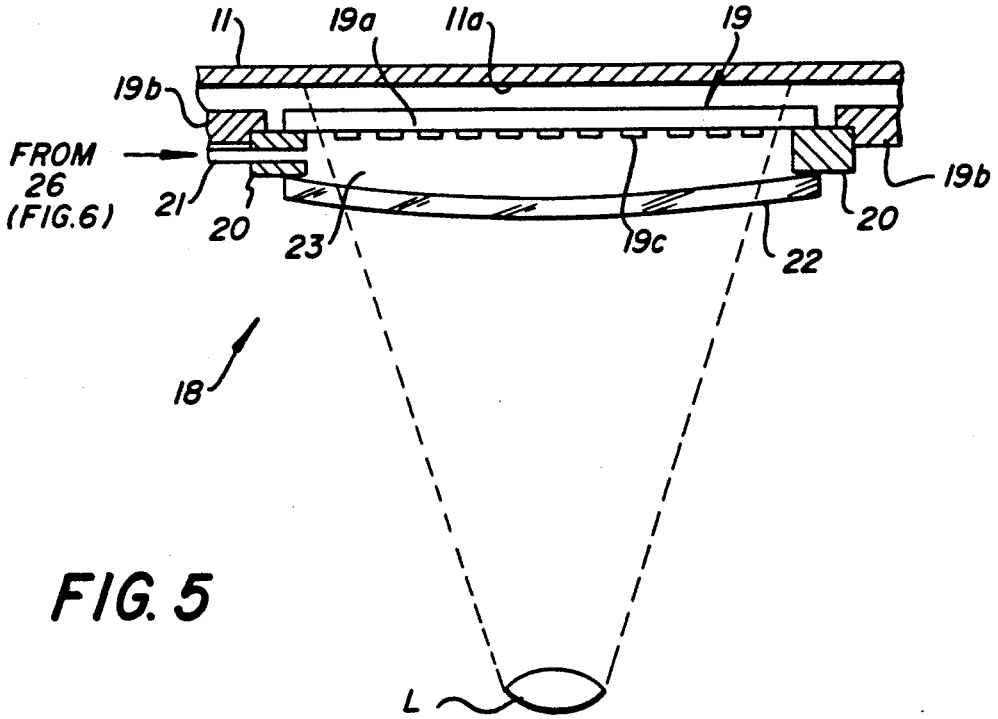
FIG. 5

PRESSURIZED SCREEN ASSEMBLY FOR EXPOSURE OF A CONTINUOUS TONE IMAGE

BACKGROUND OF THE INVENTION

1. Field of the Invention

This invention relates to an illumination and exposure system for a photographic or reprographic apparatus and more particularly to an improvement in a halftone screen and support for imagewise exposure of a photosensitive member.

2. Brief Description of the Prior Art

An original image that consists of a broad range of tones or gradations of tones is known as a continuous tone image. In several applications of the photographic and reprographic arts, such as in letterpress and offset lithography, such tones cannot be reproduced by varying the amounts of print ink. These printing processes can only print a solid density of color in the image areas, while ink is absent in the non-image areas. In applications of the electrophotographic reproduction art, when reproducing continuous tones, a reproduction can suffer from edge effects and halos. Thus, the reproduced image has a contrasty, washed-out appearance. To provide good image quality, resort may be made to a carefully controlled development process which typically requires the use of special devices, such as a development electrode. Such a technique, and the associated apparatus, can be costly and complex.

In order to reproduce the varying tones of a continuous tone original image, practitioners in graphic arts photography and reprography therefore utilize a halftone screen. Halftoning, (altering the imagewise exposure by, for example, locating the screen in the optical exposure path) makes the reproduction of a continuous tone image possible by converting the continuous tones into a pattern of very small, clearly defined dots of varying sizes. During exposure of the photosensitive member, the light reflected or transmitted from an original is projected through the transparent portions (or openings) of a screen. Each opening produces a transmission density gradient at the image plane on the photosensitive member. Each dot exposure is proportional in size to the amount of light provided by the respective portion of the original imaged on the opening. Using a stepped gray scale to represent the tones in an original image, a quality reproduction is ultimately provided whereby the darkest area of the original is reproduced as a solid (of large merged dots) and the lightest area is reproduced without a dot (i.e., dots of zero size).

The use of screen patterns and screening processes to improve the rendition of images is known in the fields of photography and electrostatography. See, for example, U.S. Pat. No. 3,493,381, issued in the name of Maurer and U.S. Pat. No. 2,598,732 issued in the name of Walkup. These patents also disclose a variety of screen patterns including lines, circular or rectangular dots, checkerboard patterns, etc.

U.S. Pat. No. 4,227,795, issued to Bobbe et al, is an example of the use of a screening process in multicolor electrography. The disclosed screening process may be carried out by transmitting a light image of the original document through a screen to expose a charged photoconductive member. Alternatively, an image of a screen pattern can be formed on the charged photoconductor either before or after the image of the original document is formed on the photoconductor. In U.S. Pat. Nos. 4,472,047 and 4,537,490, issued to Stoudt, a method and apparatus are disclosed for electrophotographically producing high quality black-and-white and color reproductions of originals having differing types of image content. A half-tone screen is employed in the optical path between the original and a photoconductor image sector.

As mentioned with reference to U.S. Pat. No. 4,227,795, a screen may be used to expose the photosensitive member before or after the member is exposed to the original image. For example, collimated light rays from a small, concentrated point light source are projected to a screen pattern over a rectangular aperture. In such a case, the illumination is directed through the dot screen so as to create a regular pattern of light on the photosensitive member. (A post-imagewise exposure through the screen affords a similar effect.) In either case, a latent image of the original is produced that is substantially equivalent to that provided by the screen when interposed in the imagewise exposure path.

Examples of such pre- or post-exposure screening are disclosed in U.S. Pat. Nos. 4,459,011 and 4,477,177, issued to Day, wherein an apparatus is provided for projecting a dot screen pattern onto a moving photoconductor. The compact screen projector disclosed in U.S. Pat. No. 4,459,011 provides the projection of a screen pattern onto a light sensitive surface, such as a photoconductor. The projecting apparatus comprises a member having a screen pattern including opaque and transparent areas. The member is positioned adjacent the photoconductive surface, and a Fresnel lens is located between the member and the image source. The screen member has thereon a screen pattern comprising opaque and transparent areas. A concentrated source of light rays is spaced from the Fresnel lens, and means are provided for folding light rays from the light source a plurality of times and then directing the light rays onto the lens. In U.S. Pat. No. 4,477,177, the projecting apparatus comprises an elongate transparent cylinder positioned closely adjacent to the photoconductor in the area where the photoconductor travels around a drive roller. The dot pattern is projected onto the photoconductor after it passes the charger and before it reaches an exposure station. However, the cylinder apparatus can be located to project the dot pattern onto the photoconductor after it passes the exposure station.

Quite commonly, the screen in a camera or copier apparatus useable for reproducing a continuous tone or color will be mounted in a horizontal plane. The screen is often mounted in close proximity to the horizontal portion of the photosensitive member. Such a horizontal mounting (of the screen in the optical path of the exposure optics) is also found in a variety of other reprographic and photographic apparatus. It is desirable to interpose the dot screen in the imaging optical path at a small, accurately-controlled distance from the photoconductor image plane. The spacing between screen and photosensitive member is minimal because of the necessary fineness of the dot pattern. To prevent tone scale distortion of the image in an electrophotographic application, for example, the screen must be uniformly separated from the image plane at a distance of typically 0.040 to 0.050 inches (1.0 to 1.3 millimeters).

The screen is typically fixed on the surface of a glass (or similar) substrate which provides mechanical support and optical transparency at the same time. If the image plane is horizontal and the substrate is as broad as the imaging area on the photosensitive member, the dot screen and substrate will usually sag due to the pull of gravity. As illustrated in FIG. 3, the sag at the middle of the image area is typically beyond an acceptable tolerance (for example, in one electrophotographic copier that sag was found to exceed a maximum tolerance of 0.003 inches (0.076 millimeters) from the screen mounting plane). The sag constitutes a variation in the spacing between the screen and the image plane. This variation causes the imaged screen pattern (the imaged dot pattern on the photosensitive member) to be correspondingly distorted. The imaged dot pattern will thus be composed of dots having a non-uniform spacing. The screening process is thus optically impaired and the fidelity of the reproduction to the original is therefore compromised.

The conventional response to this sag induced image distortion is to introduce a compensating distortion (curvature) of the image plane in order to restore the required uniformity of spacing between screen and image plane over the entire image area. However, this approach is difficult, costly, and itself can nonetheless introduce other types of image degradation.

It is an object of this invention therefore to provide for the reproduction of a continuous tone image without the deleterious effects of the conventional screen apparatus described above. A further object is to provide a halftoning screen and support that is not subject to the aforementioned sag and the associated effect of image degradation. It is a still further object to provide a halftoning screen and support that is simple, inexpensive, and easily implemented in any type of reprographic or graphic arts apparatus, and especially in an electrophotographic reproduction apparatus.

SUMMARY OF THE INVENTION

In accordance with the invention there is provided in a reproduction apparatus and method wherein an original to be reproduced is supported and exposed by projection through a pressurized halftone screen assembly onto a moving photosensitive member.

The preferred embodiment of the apparatus comprises a pressurized screen assembly mountable on a support for halftone exposure of a movable photosensitive member. The apparatus includes a halftoning screen member, a light-transmissive cover positioned in spaced relation to the screen member, and a seal, interposed between the cover and the screen member and defining a cell therebetween. A passage through the seal allows the application of a pressure change to the cell to cause a deformation of the screen member. The screen member is thus positioned in a predetermined spaced relationship with the photosensitive member.

In another embodiment of the present invention, there is provided a reproduction apparatus for producing one or more copies of an original. The reproduction apparatus includes a means for supporting the original, a movable photosensitive member upon which an image of the original is to be exposed, means for moving the photosensitive member through an exposure station means, and an exposure station means including means for exposing the photosensitive member to a light image of the original. The exposing means further includes means for projecting a light image of the original along an optical path to an image plane on the photosensitive member, and a halftoning screen member positioned in the optical path for screening the light image formed by the projecting means. The screen member, being oriented so as to have a tendency to sag in the influence of gravity, is deformable by a pressurizing means for flattening the screen to overcome the tendency of the screen to sag.

In another aspect of the present invention there is provided a method of reproducing an original. The method involves projecting the light image of the original along an optical path to an image plane on a photosensitive member, positioning a halftoning screen member in the optical path, the screen member being oriented so as to have a tendency to sag in the influence of gravity, and flattening the screen member to overcome the tendency of the screen to sag.

BRIEF DESCRIPTION OF THE DRAWINGS

The subsequent description of the preferred embodiment of the present invention refers to the attached drawings wherein:

FIG. 4 is a schematic side view of an pressurized screen assembly which is constructed according to principles of the present invention;

FIG. 5 is a schematic side view of an alternative embodiment of the screen assembly of FIG. 4.

DETAILED DESCRIPTION OF THE PREFERRED EMBODIMENTS

Because electrophotographic reproduction apparatus are well known, the present description will be directed in particular to elements forming part of or cooperating more directly with the present invention. Apparatus not specifically shown or described herein are selectable from those known in the prior art.

Figure 1:
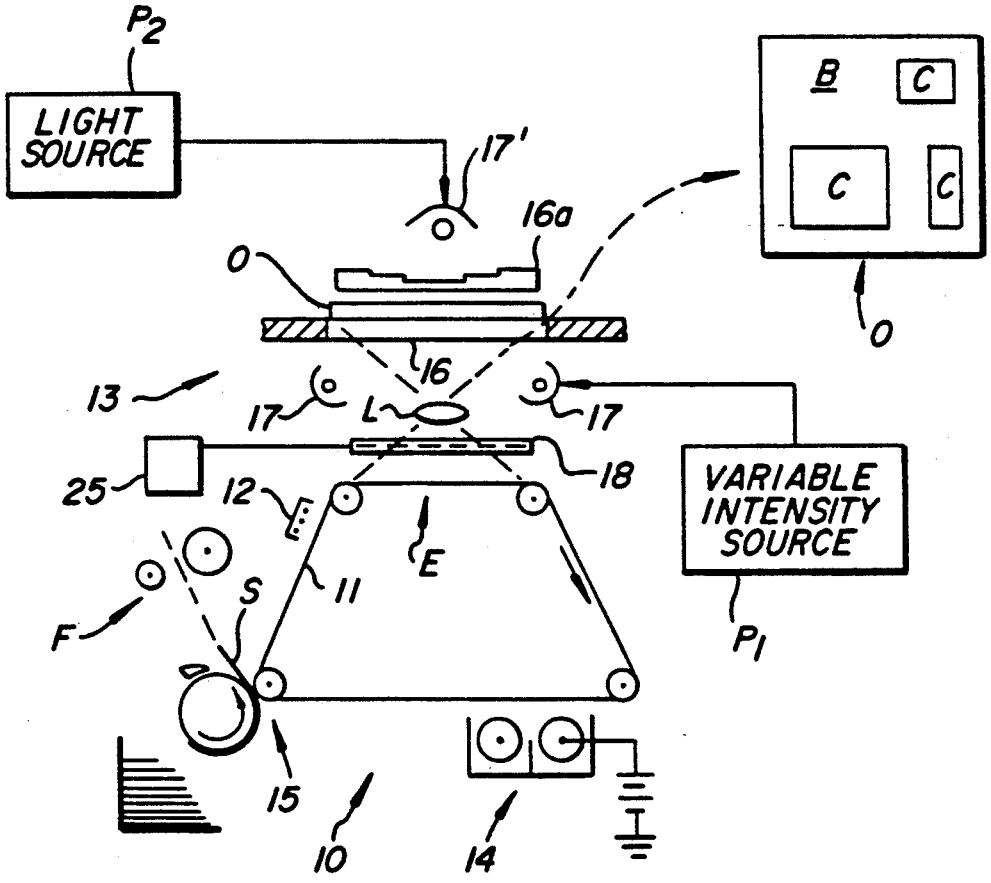
FIG. 1 is a schematic side view of an exemplary reproduction machine of the type adapted to incorporate the pressurized screen assembly of the present invention.

Referring now to FIG. 1, there is shown an apparatus 10 which is adapted, in accordance with one aspect of the present invention, to produce electrophotographic reproductions of documents which include continuous-tone image areas therein. One advantageous feature of the FIG. 1 structure is its capability to produce good tone-scale. The apparatus 10 includes a photosensitive member, or photoconductor 11. The endless-loop photoconductor 11 comprises a photoconductive insulator layer overlying a conductive layer on a support. One or more image sectors on the photoconductor are adapted for movement along an operative path past primary charging station 12, exposure station 13, development station 14 and transfer station 15. The corona charger at station 12, magnetic brushes at station 14 and transfer roller at station 15 can be of the various types known in the art and equivalent devices can be utilized. The inventive structural and procedural aspects of the FIG. 1 embodiment of the invention pertain to a pressurized screen assembly 18 and pressurizing means 25 in exposure station 13.

The exposure procedure involves provision and use of an original O which comprises one or more reflective continuous-tone areas C (for example, photographs or illustrations) formed on a background B. Typically the original is composed in an editing process to include photographic prints and pasted portions of line text mounted on a white paper support. Alternatively, the original may be a continuous tone negative transparency. In accordance with the present invention, the exposure station 13 includes means for supporting original O (e.g., transparent platen 16) at the illumination zone of apparatus 10, a first illuminations source 17 located between the illumination zone and the photoconductor 11 and second illumination source 17' located on the opposite side the illumination zone from photoconductor 11. Lens means L is provided to image the original at the illumination zone onto the photoconductor 11 at an image plane 11*a* in exposure zone E and a Fresnel-type field lens element 16*a* images the transmission source 17' on the lens L. A particularly preferred embodiment includes a pressurized screen assembly 18 located in the optical path of lens L and proximate the exposure zone. The pressurized screen assembly 18 includes a screen pattern composed of one of various dot or line patterns known in the art. Such are disclosed, in part, in the disclosures discussed in the Background of the Invention of this specification.

In operation, an image sector on the photoconductor 11 is moved past the charging station 12, where it receives a uniform primary electrostatic charge, and into exposure zone E. At this stage illumination sources 17 or 17' (depending upon whether, respectively, the original is selectively reflective or transparent) are actuated to illuminate the original O. More particularly, source 17 is a pair of xenon flash lamps energized by power source $P_1$ at an intensity level selected for optimizing the tone-scale of the electrostatic latent image formed on the photoconductor by light reflected from the continuous-tone portions C. Alternatively, the light source 17', e.g., a xenon flash lamp, may be selected and energized by its power source $P_2$ to provide an exposure level at the photoconductor which discharges portions of the photoconductor by transmission exposure if the original is a transparency. The pressurized screen assembly 18 may optionally be deployed by a known servo-system positioning means (not shown) such that it can be removed from the optical path when screening is not required. Rotation of the screen assembly 18 in the horizontal plane can also be effected by such apparatus to prevent Moire patterns in the reproduction as is known in the art. However, for clarity in describing the invention, the screen 19 will be assumed to be installed for continuous operation in the exposure station 13.

The exposure provided by source 17 or 17' to the original O is passes through the screen pattern of screen member 19 and discharges the photoconductor 11 in an imagewise pattern to provide a latent image. The electrostatic latent image is then developed with toner at a development station 14, and the resulting toner image is transferred to copy sheet and fixed at a fusing station F. The exposure of the photoconductor 11 can be chosen to optimize the tone-scale of the electrostatic image. The use of the interposed screen member 19 allows substantial improvement in the quality of electrophotographic reproductions of images which contain continuous tone image content. Although the exposure is directed upon a flexible photoconductor, it will be understood that the invention is equally applicable for use with other photoconductor configurations and with other photosensitive media, such as photographic film.

If the pressurized screen assembly 18 is located sufficiently close to the photoconductor to therefore become gradually contaminated, for example, by particles of toner from the photoconductor, apparatus can be provided for cleaning such particles from the screen assembly. Such apparatus is disclosed in U.S. Pat. Nos. 3,961,848 and 3,958,877, the contents of which are incorporated herein by reference.

As will be readily appreciated by those skilled in the art, the level of photoconductor exposure of the continuous-tone images can be varied in ways other than adjustment of the illumination intensity of source $P_1$, e.g., such as by aperture adjustment and/or illumination time control. Similarly, one skilled in the art may readily substitute other exposure techniques, e.g., scan exposure techniques, for the flash exposure system described with respect to FIG. 1. In certain applications, the exposure of transparency originals will be unnecessary and the transmissive exposure apparatus, namely the source $P_2$, lamp 17', and lens 16*a*, may be omitted for simplicity of operation.

Figure 2:
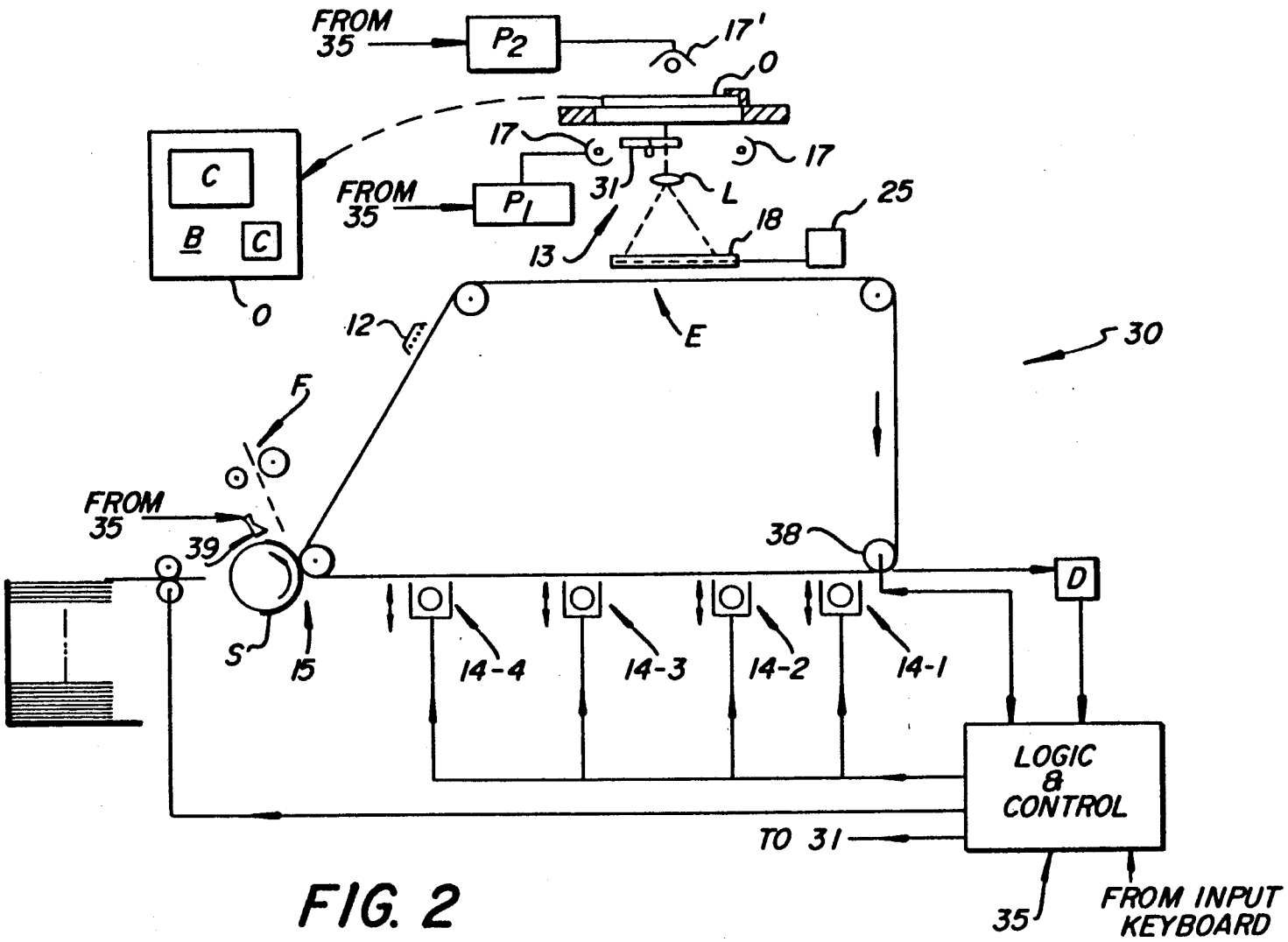
FIG. 2 is a schematic side view of another exemplary reproduction machine similar to that of FIG. 1 but useable for multicolor reproduction.

Referring now to FIG. 2, apparatus 30 provides features and advantages such as previously described but in an embodiment capable of producing color (in addition to black-and-white) reproductions of originals containing continuous tone content.

In this regard, an array 31 of color filters, e.g., red, green, and blue filters, is mounted along the optical path of exposure station 13. The array 31 is indexable to selectively position a particular color filter in the optical path during the successive color-separation exposures of continuous-tone portions C of the color original O. The development means 14 includes discrete magnetic brush devices 14-1, 14-2, 14-3, 14-4, which respond to signals from logic and control unit 35 to selectively apply different colors of toner (e.g., cyan, magenta, yellow and black toner) to different photoconductor image sectors. The functioning of these additional devices in cooperation with the other structure of electrophotographic apparatus 30 will be easily understood by considering the following operational descriptions of its different modes.

To commence operation of a color copy run, the original O is positioned on platen 16. In the illustrated embodiment, original O comprises a plurality of color continuous-tone information areas C (e.g., color prints) mounted on a support which forms background area B.

A "run" command is actuated by the operator on an apparatus keyboard (not shown), and successive photoconductor image sectors on the photoconductor belt 11 move by a primary charger 12 and into exposure zone E. The position of the photoconductor image sectors is detected by a sensor, e.g., a detector D of perforations in the photoconductor, and a position signal is input to a logic and control unit 35. The unit 35 effects control of successive red, green and blue color exposures respectively onto the successive photoconductor sectors. For example, such control can include an indexing of filter array 31 or energization of power sources $P_1$ or $P_2$ at the desired level(s). The three photoconductor image sectors, thus exposed, respectively comprise screened, continuous-tone red, green, and blue color-separation electrostatic images corresponding to the original O. As the sector bearing the red color-separation electrostatic image moves over magnetic brush 14-1, the brush is activated by unit 35 to apply cyan toner in accordance with the electrostatic image. Similarly brushes 14-2 and 14-3 are activated to apply magenta and yellow toner respectively to the subsequent green and blue electrostatic color-separation images at the image planes of successive sectors of the photoconductor 11.

As a fourth primary-charged sector of the photoconductor belt 11 passes zone E, a panchromatic light exposure of selected tone-scale is effected by source 17 or 17'. It may be preferred to filter this exposure with another element of array 31, e.g., a neutral density filter element, to achieve a more panchromatic system response for this exposure. An electrostatic pattern is thus effected on the fourth photoconductor image sector in proper timed relation with movement of belt 11. The fourth sector subsequently is developed with black toner by a magnetic brush 14-4. It will be appreciated that the logic and control unit 35 can effect the above-described exposures of the four photoconductor image sectors in registration therebetween and in any desired sequence. Also, it will be appreciated that the unit 35 can control individual image frame exposures that correspond respectively to the color separations of a multicolor original O. Of course, the apparatus 30 can employ less than four colors, if desired.

After exposure and development, and in proper timed relation with movement of the photoconductor image sectors to the transfer station 15, the logic and control unit 35 signals actuation for feeding a copy sheet S to the transfer roller. Successive cyan, magenta, yellow, and (if used) black toner images are then transferred to the copy sheet, in register, at the first, second, third, and fourth image sectors of the photoconductor 11. Unit 35 then signals pick-off of the copy sheet by detack device 39, and copy sheet S is fed through fixing device F to a receiver bin. Appropriate photoconductor cleaning and rejuvenation is provided along the return path as known in the art. Apparatus for providing such registered transfer is fully described in U.S. Pat. No. 4,477,176, issued Oct. 16, 1984 in the name of Matthew J. Russel, the contents of which are incorporated herein by reference.

It will be appreciated that successive multicolor reproductions of the original can be made in a continuous mode by repeating the above-described operation as the belt recirculates. Moreover, a set of color separation sheets (also known as color masters) may be reproduced according to the above-described process, but with minor alterations. The color separation image frames are developed with a single color toner, e.g., black. The pick-off is made after one toner image is transferred to a sheet, and each subsequent transfer is to a fresh copy sheet that is introduced to the transfer station 15 in timed relationship to the approach of the next toner image. Each copy sheet is removed by the detack device for subsequent fusing of the separation image. Successive sets of masters can be made in a continuous mode by repeating this operation, also.

Figure 3:
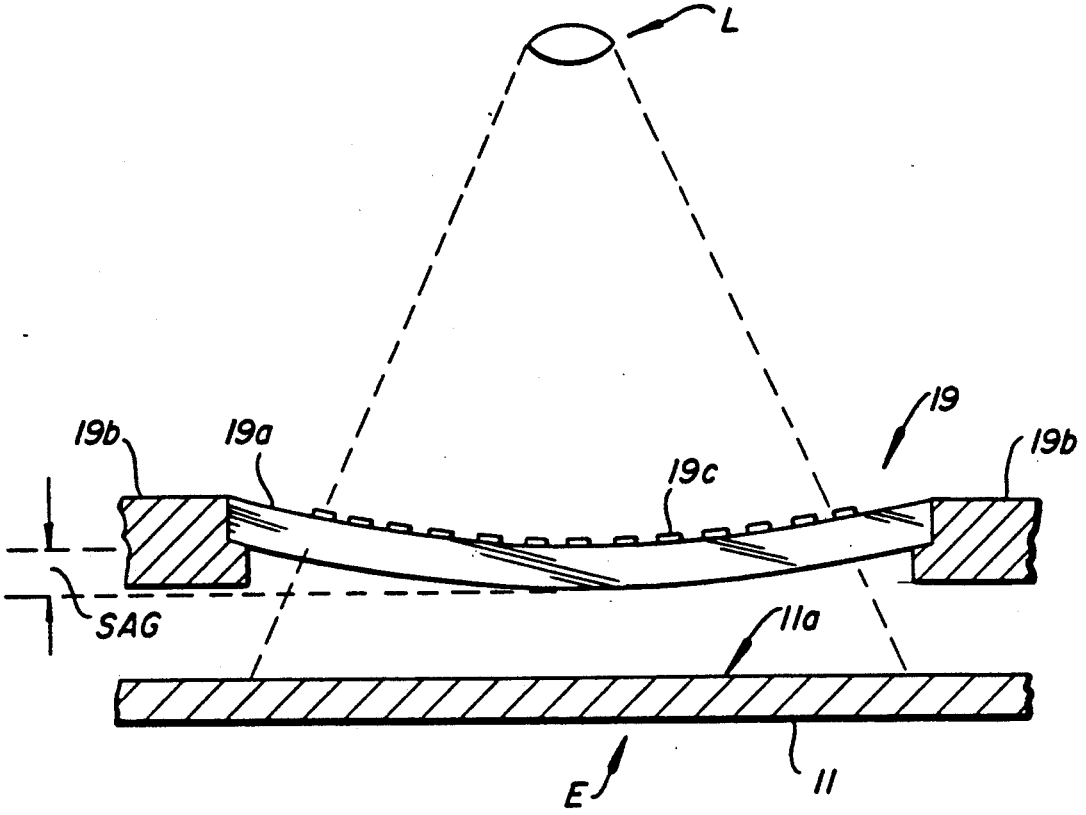
FIG. 3 PRIOR ART
FIG. 3 is a schematic side view of a screen and support typical of the type found in prior art.

With reference to FIG. 3, the inadequacy of prior art screen members will be realized. The screen member 19 is formed from an optically transparent substrate **19*a* having one exterior surface covered with a screen pattern, e.g., of opaque dots 19*c*. The dots are arranged in rows and columns across the surface of the screen member 19 but can also be arranged in other patterns or arrangements of dots. For example, the screen pattern may comprise a line pattern of a type known in the art. The peripheral edge of the screen member 19 is typically mounted on a support 19*b* so as to not obscure the optical field of the screen. Consequently, the screen member 19 suffers from sag (distortion induced by the weight of the screen member 19 itself). The separation between the screen member 19 and the photoconductor 11** is thus non-uniform and the image is degradated during the screened exposure.

With reference to FIGS. 4 and 5, a preferred embodiment of a pressurized screen assembly 18 according to the present invention is illustrated. FIG. 4 illustrates the screen assembly 18 mounted above the image plane **11*a* of the photoconductor 11; FIG. 5 illustrates an alternative application of the screen assembly 18 mounted below the photoconductor 11. In either case, and in the absence of the inventive features of the illustrated embodiment, the screen member 19 would be distorted as was discussed in reference to FIG. 3. In the preferred embodiment, the screen member 19 is assembled with a transparent cover 22 to form an air cell 23. The transparent cover 22 is composed of glass or other material having negligible optical effect. A semi-rigid seal 20 is provided between the cover 22 and the screen member 19 to complete the enclosure of the air cell 23, and a passage 21 through the seal 20 enables an adjustment of the internal (cell) pressure of the screen assembly. The seal 20 may be fixed to the peripheral portions of the cover 22 and screen member 19 by use of a sealant or other adhesive, and the exterior of the seal 20 is further attachable to the support 19*b* by a similar adhesive, or by known mechanical means. The gasket 20 is extensive beyond the periphery of the screen member 19 to thus provide mechanical support by its attachment to the support 19*b*. The central portions of the cover 22 and screen member 19** are unobscured by the seal so as to permit a full field of exposure through the screen assembly.

In the process of pressurizing the screen assembly 18, the air cell is slightly evacuated (for an upwardly facing photoconductor image plane **11*a*, as in FIG. 4) or compressed (for a downwardly facing image plane 11*a*, as in FIG. 5) by applying a respectively negative or positive air pressure to the passage 21. Such pressures are referenced to the atmospheric pressure external to the screen member 19. The pressure in the air cell 23 is selected and maintained at a level sufficient to deflect the substrate 19*a* in a direction contrary to the aforementioned sag such that the screen member 19 becomes planar and parallel with the image plane 11*a* of the photoconductor 11. Although the screen assembly is preferably pressurized with air, other optically transmissive fluids may be introduced into cell 23** to pressurize it as well.

The preferred embodiment therefore eliminates the sag-induced optical distortion of the screen pattern exposure at the photoconductor image plane **11*a*. The spacing of the dots, lines, or other pattern elements in the screened exposure uniformly correspond to the spacing of the pattern 19*c* on the screen member 19. Accurate halftoning of the continuous tone image is thereby provided with none of the deleterious effects described hereinabove with respect to sag-induced optical distortion. It is to be understood that the illumination of the preferred embodiment may also be provided by a point source, as in a pre- or post-imagewise exposure of the photoconductor 11**, as was discussed in the Background of the Invention. Such pattern exposures of the photoconductor are, nonetheless, free of sag-induced distortion.

The required pressure at the air cell 23 is generally only a slight deviation from normal atmospheric pressure. The deviation from atmospheric pressure, expressed in inches of water, of the magnitude of the air cell pressure $P_c$ is equal to the screen member substrate thickness $T_s$ (in inches) multiplied by the relative density of the substrate $d_s$. For example, a substrate made of 0.125 inch (3.1 millimeters) thick glass, which typically has a relative density of 2.5, requires an air pressure deviation of 0.3125 inches (7.8 millimeters) of water. The polarity of the applied pressure deviation is, as mentioned, positive or negative depending upon the application.

Figure 6:
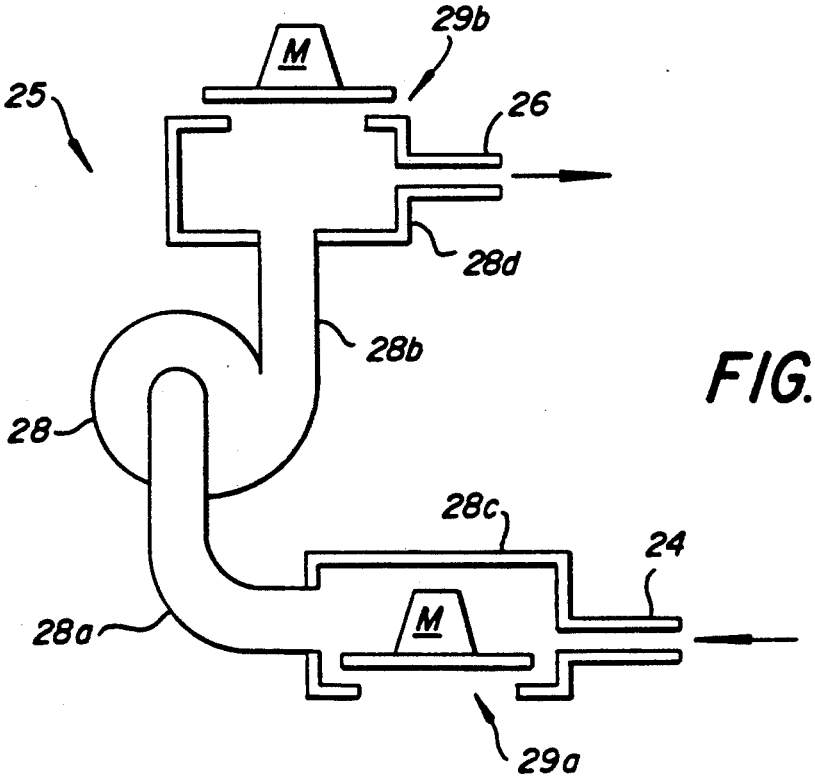
FIG. 6 is a schematic and cross-sectional side view of a pressurizing means for use in pressurizing the screen assembly of FIGS. 3 and 4 in the practice of the present invention.

As shown in FIG. 6, a preferred embodiment of a screen assembly pressurizing means 25 is provided for establishing the aforementioned regulated air cell pressure. A blower 28 includes an intake 28*a* and an output 28*b* which respectively communicate with negative and positive pressure plenums 28*c* and 28*d*. Air is drawn into the negative pressure plenum 28*c* from an intake port 24 and blown through the positive pressure plenum 28*d* to an output port 26. The blower 28 simultaneously provides a negative pressure at the intake port 24 and a positive pressure at the output port 26. These pressures are respectively regulated as deviations from atmospheric pressure by the flow of excess air through weighted plenum orifices 29*a* and 29*b*. The deviation pressures at the input and output ports 24 and 26 are set by selecting an appropriate mass M to provide a relief valve action at the orfices. Because the pressures required by the screen assembly are only slight deviations from atmospheric pressure, a very low flow volume takes place in the blower 28. Enough air flow is necessary only to provide for reliable operation of the pressure regulation. Accordingly, the pressurizing means 25 can be constructed of quite inexpensive components, and the operable life of the pressurizing means 25 can be very long. Alternatively, the cost may be further reduced by eliminating the blower 28 and attaching the intake 28*a* and the output 28*b* to respective "bleed" intake and output ports of a pre-existing pressure system (not shown) in the reproduction apparatus 10 or 30.

The preferred embodiments of the invention has a further advantage which allows it to be operated over a long life with little or no maintenance. The air flow through the air cell 23, upon reaching the selected pressure, is zero. Therefore, no dust or dirt is progressively introduced into the air cell 23, and the quality of reproductions made with the use of the preferred embodiment is consistently high.

The invention has been described in detail with particular reference to preferred embodiments thereof, but it will be understood that variations and modifications can be effected within the spirit and scope of the invention.

What is claimed is:

1. A pressurized screen assembly mountable on a support for halftone exposure of a photosensitive member, comprising:

a halftoning screen member;

a light-transmissive cover, positioned in spaced relation to the screen member; and a seal, interposed between the cover and the screen member and defining a cell therebetween, having a passage therethrough for applying a pressure to the cell;

whereby a pressure applied to the cell causes a deformation of the screen member to position same in a predetermined spaced relationship with the photosensitive member.

2. A pressurized screen assembly as claimed in claim 1, wherein the seal is adapted at its periphery for mounting and fixing the screen assembly on the support.

3. A pressurized screen assembly as claimed in claim 1, wherein the screen member comprises:

an optically-transmissive planar substrate; and a layer of opaque material selectively deposited on one surface of the substrate in a predetermined pattern;

whereby the screen member provides halftone screening of an image projected therethrough.

4. A pressurized screen assembly as claimed in claim 1, further comprising;

a cell pressurizing means attachable to the passage for providing a selected pressure in the cell;

whereby the applied pressure causes the screen member to assume a planar configuration that is substantially parallel to the surface of the photosensitive member.

5. A reproduction apparatus for producing one or more copies of an original, comprising:

a movable photosensitive member upon which an image of the original is to be exposed;

means for moving the photosensitive member through an exposure station means;

an exposure station means including means for exposing said photosensitive member to a light image of the original, the exposing means further including means for projecting a light image of the original along an optical path to an image plane on the photosensitive member;

a halftoning screen member positioned in the optical path for screening the light image formed by the projecting means, the screen member being oriented so as to have a tendency to sag in the influence of gravity; and pressurizing means for flattening the screen to overcome the tendency of the screen to sag.

6. A reproduction apparatus as claimed in claim 5, wherein the pressurized screen assembly further comprises:

a light-transmissive cover, positioned in spaced relation to the screen member; and a seal, interposed between the cover and the screen member and defining a pressure cell therebetween, having a passage therethrough for applying the pressure;

whereby the applied pressure causes the screen member to assume a substantially planar shape parallel to the image plane of the photosensitive member.

7. A reproduction apparatus as claimed in claim 5, wherein the original comprises a multicolor image and the exposure station means further comprises:

means for exposing multiple color separation image frames of the original in registration on the photosensitive member;

means for developing the multiple color separation frames in respectively-pigmented marking particles for providing respective transferable images; and means for transferring at least one of the developed images to a receiver sheet.

8. The reproduction apparatus of claim 7, wherein the photosensitive member is a photoconductor, and further comprising:

charging means for applying to the photosensitive member a primary electrostatic charge to be modulated by the screened imagewise exposure;

whereby the development means develops the modulated electrostatic charge in an exposed image frame to provide a developed transferable image.

9. A method of reproducing an original, comprising:

projecting a light image of the original along an optical path to an image plane on a photosensitive member;

positioning a halftoning screen member in the optical path, the screen member being oriented so as to have a tendency to sag in the influence of gravity; and pressurizing the screen member to overcome the tendency of the screen to sag;

whereby said pressurizing causes a deformation of the screen member to position same in a predetermined spaced relationship with the photosensitive member and whereby the light image formed by the projecting means is screened.

10. The method of reproducing an original as claimed in claim 9, wherein the step of flattening the screen member further comprises the step of adjusting the pressure on the screen member of a fluid in a cell partially enclosed by the screen member.

* * * * *